US007443997B2

(12) United States Patent
Miller et al.

(10) Patent No.: US 7,443,997 B2
(45) Date of Patent: Oct. 28, 2008

(54) ARMATURE FOR A RECEIVER

(75) Inventors: Thomas Miller, Arlington Heights, IL (US); Daniel Warren, Geneva, IL (US)

(73) Assignee: Knowles Electronics, LLC., Itasca, IL (US)

( * ) Notice: Subject to any disclaimer, the term of this patent is extended or adjusted under 35 U.S.C. 154(b) by 333 days.

(21) Appl. No.: 10/769,528

(22) Filed: Jan. 30, 2004

(65) Prior Publication Data

US 2004/0184636 A1 Sep. 23, 2004

Related U.S. Application Data

(63) Continuation of application No. 09/850,776, filed on May 8, 2001, now abandoned.

(60) Provisional application No. 60/218,996, filed on Jul. 17, 2000, provisional application No. 60/202,957, filed on May 9, 2000.

(51) Int. Cl.
*H04R 25/00* (2006.01)

(52) U.S. Cl. ..... 381/417; 381/418; 381/322; 381/324

(58) Field of Classification Search ..... 381/417, 381/418, 322, 324, 176
See application file for complete search history.

(56) References Cited

U.S. PATENT DOCUMENTS

| | | | | |
|---|---|---|---|---|
| 3,002,058 | A | 9/1961 | Knowles | |
| 3,515,818 | A * | 6/1970 | Tibbetts | 381/189 |
| 3,588,383 | A | 6/1971 | Carlson et al. | |
| 3,617,653 | A | 11/1971 | Tibbetts | |
| 3,935,398 | A * | 1/1976 | Carlson et al. | 381/386 |
| 4,002,863 | A | 1/1977 | Broersma | |
| 4,015,227 | A | 3/1977 | Riko et al. | |
| 4,109,116 | A | 8/1978 | Victoreen | |
| 4,272,654 | A | 6/1981 | Carlson | |
| 4,410,769 | A | 10/1983 | Tibbetts | |
| 4,473,722 | A | 9/1984 | Wilton | |
| 4,628,907 | A | 12/1986 | Epley | |
| 4,956,868 | A | 9/1990 | Carlson | |
| 5,068,901 | A | 11/1991 | Carlson | |

(Continued)

FOREIGN PATENT DOCUMENTS

| | | | |
|---|---|---|---|
| GB | 2 229 339 | A | 9/1990 |

*Primary Examiner*—Wayne Young
*Assistant Examiner*—Dionne H Pendleton
(74) *Attorney, Agent, or Firm*—Marshall, Gerstein & Borun LLP

(57) ABSTRACT

An armature for a receiver comprising a first and a second leg portion each having a thickness and a width and connected to each other, and a connection portion in communication with the first and second leg portions. The connection portion has a width greater than the width of the first and second leg portions individually. The connection portion reduces the stiffness of the armature and minimizes magnetic reluctance of the connection between the first and second leg portions. According to one aspect of the invention, the first and second leg portions are integrally formed with the connection portion and the connection portion includes at least a portion having a thickness less than the thickness of the first and second leg portions individually to reduce the stiffness of the armature. According to another aspect of the invention, the first and second leg portions are separately formed and attached to the connection portion in a way that reduces the stiffness of the armature.

4 Claims, 3 Drawing Sheets

U.S. PATENT DOCUMENTS

| | | | | |
|---|---|---|---|---|
| 5,193,116 | A | 3/1993 | Mostardo | |
| 5,647,013 | A | 7/1997 | Salvage et al. | |
| 5,757,947 | A | 5/1998 | Van Halteren et al. | |
| 5,809,158 | A | 9/1998 | van Halteren et al. | |
| 5,960,093 | A | 9/1999 | Miller | |
| 6,041,131 | A | 3/2000 | Kirchhoefer et al. | |
| 6,075,870 | A | 6/2000 | Geschiere et al. | |
| 6,078,677 | A | 6/2000 | Dolleman et al. | |
| 6,658,134 | B1 * | 12/2003 | van Hal et al. | 381/418 |
| 2002/0003890 | A1 | 1/2002 | Warren et al. | |

* cited by examiner

FIG. 11
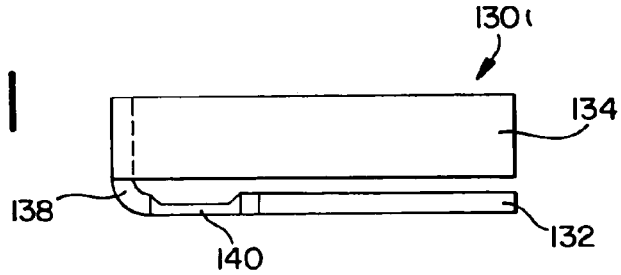
FIG. 12
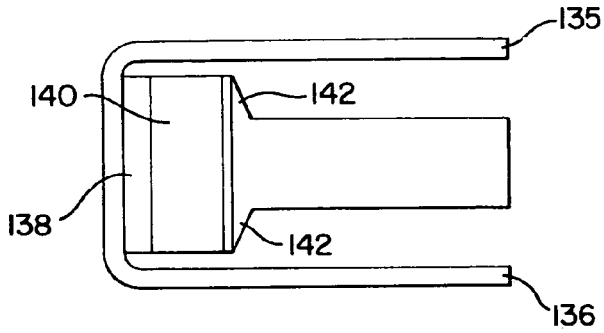
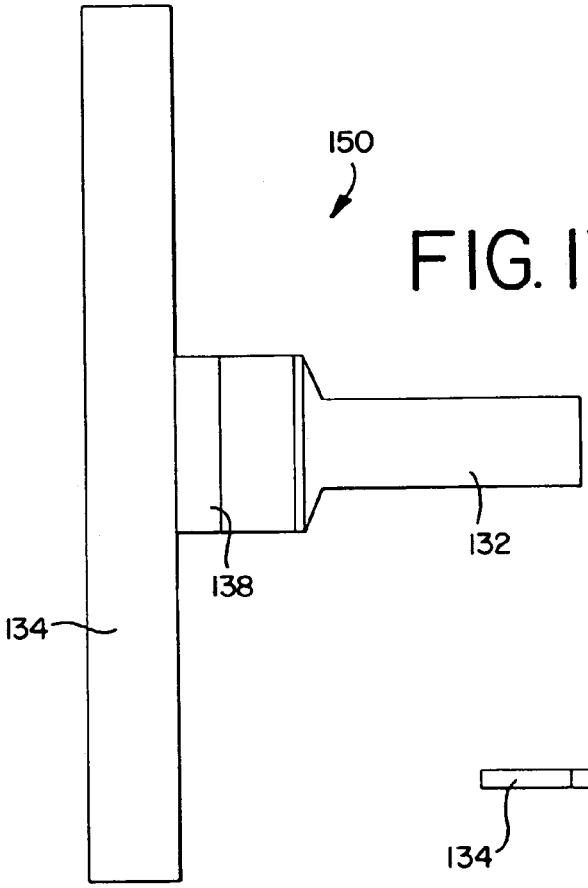
FIG. 13
FIG. 14
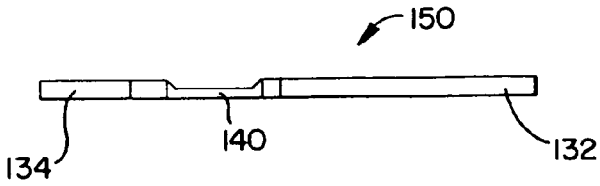

ARMATURE FOR A RECEIVER

RELATED APPLICATIONS

This application is a continuation of U.S. application Ser. No. 09/850,776, entitled "Armature for a Receiver, " filed May 8, 2001, which claims the benefit of U.S. Provisional Application No. 60/202,957, filed May 9, 2000, and U.S. Provisional Application No. 60/218,996, filed Jul. 17, 2000. U.S. application Ser. No. 09/850,776 is hereby incorporated by reference in its entirety for all purposes.

TECHNICAL FIELD

The present invention generally relates to receivers for microelectronic devices, and more particularly to armatures for use in hearing aid receiver transducers.

BACKGROUND OF THE INVENTION

Electroacoustic transducers are capable of converting electric energy to acoustic energy and vice versa. Electroacoustic receivers typically convert electric energy to acoustic energy through a motor assembly having a movable armature. Typically, the armature has one end that is free to move while the other end is fixed to a housing of the receiver. The assembly also includes a drive coil and one or more magnets, both capable of magnetically interacting with the armature. The armature is typically connected to a diaphragm near its movable end. When the drive coil is excited by an electrical signal, it magnetizes the armature. Interaction of the magnetized armature and the magnetic fields of the magnets causes the movable end of the armature to vibrate. Movement of the diaphragm connected to the armature produces sound for output to the human ear. Examples of such transducers are disclosed in U.S. Pat. Nos. 3,588,383, 4,272,654 and 5,193,116.

The sound pressure output of a receiver is created by the travel, or deflection, of the armature when it vibrates. Maximum deflection of the moving armature creates maximum sound pressure output for a given armature geometry. The maximum deflection of an armature is limited by the magnetic saturation of the armature, which is governed by the maximum magnetic flux that the armature geometry can allow to pass therethrough. Therefore, the magnetic flux must be increased in order to increase the sound pressure output. The maximum magnetic flux is limited by material type and cross-sectional area of the armature. Although an increase in the cross-sectional area causes a proportional increase in the maximum flux, the relative stiffness of the armature increases as well. Thus, merely increasing the cross-sectional area of the armature geometry does not provide a significant improvement in the maximum deflection of the armature.

The present invention addresses these and other problems.

SUMMARY OF THE INVENTION

An armature for a receiver comprising a first and a second leg portion each having a thickness and a width and connected to each other, and a connection portion in communication with the first and second leg portions. The connection portion has a width greater than the width of the first and second leg portions individually. The connection portion reduces the stiffness of the armature and minimizes magnetic reluctance of the connection between the first and second leg portions. According to one aspect of the invention, the first and second leg portions are integrally formed with the connection portion and the connection portion includes at least a portion having a thickness less than the thickness of the first and second leg portions individually to reduce the stiffness of the armature. According to another aspect of the invention, the first and second leg portions are separately formed and attached to the connection portion in a way that reduces the stiffness of the armature.

BRIEF DESCRIPTION OF THE DRAWINGS

FIG. 11 is an elevational side view of a one-piece E-shaped armature according to the present invention.

FIG. 12 is a top plan view of the E-shaped armature shown in FIG. 11.

FIG. 13 is a top plan view of a blank used to form the one-piece E-shaped armature shown in FIG. 11.

FIG. 14 is an elevational side view of the blank shown in FIG. 13.

DETAILED DESCRIPTION OF THE PREFERRED EMBODIMENTS

While the present invention will be described fully hereinafter with reference to the accompanying drawings, in which particular embodiments are shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
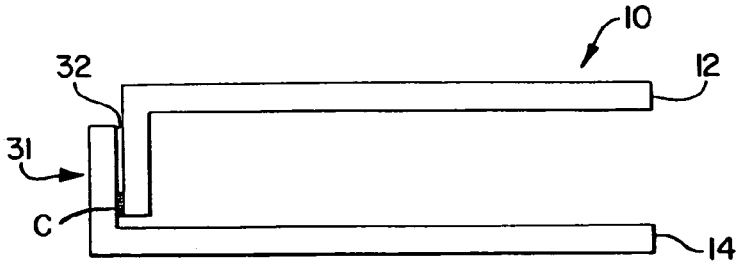
FIG. 1 is an elevational side view of a first embodiment of a two-piece armature assembly according to the present invention.
Figure 2:
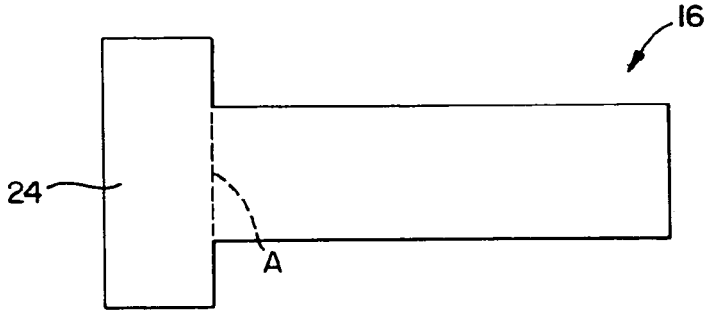
FIG. 2 is a top plan view of a first preform used to form a first leg of the armature assembly shown in FIG. 1.
Figure 3:
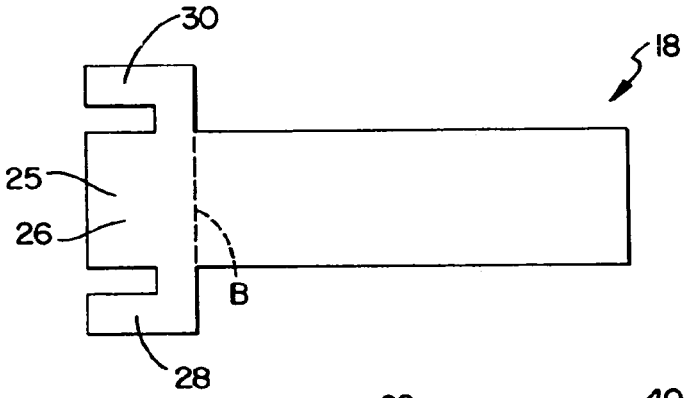
FIG. 3 is a top plan view of a second preform used to form a second leg of the armature assembly shown in FIG. 1.

FIG. 1 illustrates a first embodiment of a two-piece armature assembly 10. The armature assembly 10 comprises a first leg portion 12 and a second leg portion 14. FIG. 2 shows a preform 16 used to form the first leg portion 12. FIG. 3 shows a second preform 18 used to form the second leg portion 14. The leg portions 12 and 14 are formed by bending the preforms 16 and 18 along bend lines A and B, respectively. The bend lines A and B are merely reference lines for purposes of illustrating the line along which the preforms 16 and 18 are bent and are not formed on the preforms 16 and 18. However, in an alternate embodiment, the preforms 16 and 18 may be provided with a score line or other means (not shown) to aid in the bending of the preforms 16 and 18.

The first leg portion 12 includes a connection region or segment 24, as shown in FIG. 2. The second leg portion 14 includes a connection region or segment 25. The connection segment 25 includes a magnetic keeper region 26 and integrally formed connecting straps 28 and 30 disposed adjacent to the magnetic keeper region 26, as shown in FIG. 3. The connecting straps 28 and 30 provide a surface for the second leg portion 14 to be attached to the first leg portion 12, as shown in FIG. 1. Alternatively, the connecting straps 28 and 30 can be integrally formed with the first leg portion 12. Furthermore, the connecting straps 28 and 30 may be fabricated as separate pieces and mechanically connected to either or both of the leg portions 12 and 14. In a preferred embodiment, the first and second leg portions are welded together.

When the first and second leg portions 12 and 14 are assembled, a connection portion 31 is formed, as shown in FIG. 1. Within the connection portion 31, the connection segment 24 of the first leg portion 12 and the magnetic keeper region 26 of the connection segment 25 of the second leg portion 14 overlap and define a gap 32 therebetween, as shown in FIG. 1. The gap 32 provides clearance between the two leg portions 12 and 14 to allow adequate deflection of one of the leg portions 12 and 14 with respect to the other. Preferably, the first leg portion 12 is fixed relative to the second leg portion 14. Preferably, the leg portions 12 and 14 are fixed by a weld C disposed between the connecting straps 28 and 30 of the connection segment 25 and the connection segment 24, as shown in FIG. 1. Preferably, the weld between the connecting straps 28 and 30 of the connection segment 25 of the second leg portion 14 and the connection segment 24 of the first leg portion 12 is a contact weld. However, any type of weld well known in the metal fabrication arts can be used. To insure that a gap is formed between the connection segment 24 and the magnetic keeper region 26 of the connection segment 25, either segment 24, region 26 or the connecting straps 28 and 30 may be punched or swaged to form a bump or other raised portion (not shown) that 5 acts as a standoff between the segment 24 and the region 26 of the segment 25.

The overlapping segment 24 and region 26 of the segment 25 have a large enough surface area to minimize the magnetic reluctance between the two leg portions 12 and 14. This allows maximum magnetic flux to pass through the armature assembly 10. The gap 32 can be sized to accommodate the maximum deflection of one of the leg portions 12 and 14 for a maximum flux defined by armature assembly 10.

Figure 4:
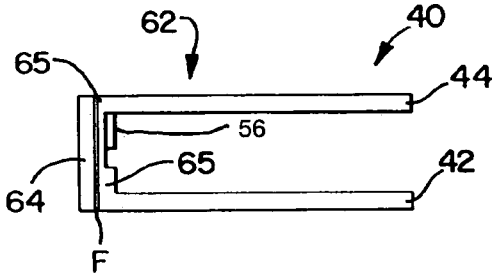
FIG. 4 is a side elevational view of a second embodiment of a two-piece armature assembly of the present invention.
Figure 5:
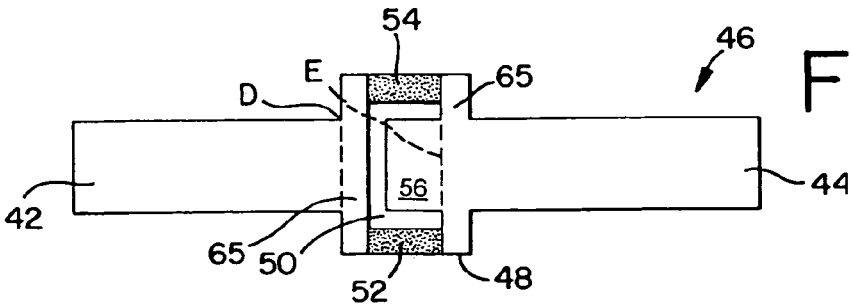
FIG. 5 is a top plan view of a preform used to form a leg portion of the armature assembly shown in FIG. 4.

FIG. 4 illustrates an alternate embodiment armature assembly 40. In this embodiment, a first leg portion 42 and a second leg portion 44 are integrally formed from a single preform 46, as shown in FIG. 5. The preform 46 includes a central connection portion 48 having a cutout 50 defining connection legs 52 and 54 and a magnetic keeper region 56. The connection legs 52 and 54 are etched or machined to be thinner than the thickness of the remaining portions of the preform 46. This reduces the stiffness of the connection legs 52 and 54 with respect to the remaining portions of the preform 46. The preform 46 is bent along bend lines D and E to form an armature leg portion 62 of the armature assembly 40, as shown in FIG. 4. In a preferred embodiment, the connection portion 48 includes a generally flat cover portion 64 that is attached to one or more other portions 65 of the connection portion 48 to complete the armature assembly 40, as shown in FIG. 4. Preferably, the cover portion 64 is welded at a weld F. The cover portion 64 provides a large surface area that overlaps and interacts with the magnetic keeper region 56 to minimize the magnetic reluctance between the first and second leg portions 42 and 44. As with the first embodiment, a raised portion (not shown) can be provided on the cover portion 64 of the connection portion 48 to act as a standoff between the cover portion 64 and the other portions 65 and the keeper region 56 of the connection portion 48.

Figure 6:
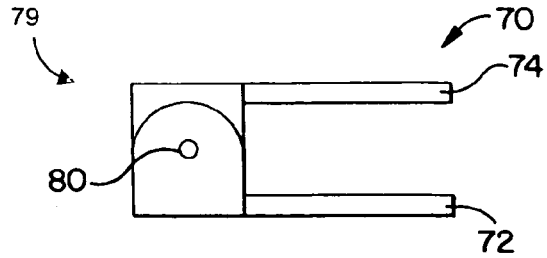
FIG. 6 is an elevational side view of a third embodiment of a two-piece armature assembly of the present invention.
Figure 7:
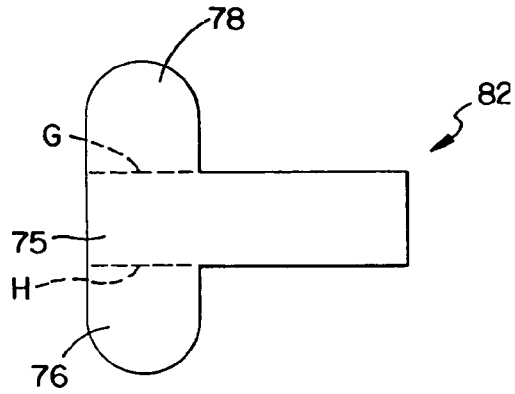
FIG. 7 is a top plan view of a first preform used to form a first leg of the armature assembly shown in FIG. 6.

FIG. 6 illustrates an alternate embodiment two-piece armature assembly 70. In this embodiment, the armature assembly 70 includes a first leg portion 72 and a second leg portion 74. FIG. 7 generically depicts a preform 82 used to form the leg portions 72 and 74 of the armature assembly 70. Each of the leg portions 72 and 74 include a connection segment 75 having two connection flaps or tabs 76 and 78 that accommodate attachment of the leg portions 72 and 74 to each other. As can be seen in FIG. 7, a width of the connection segment 75 (which comprises connection flaps or tabs 76 and 78) is greater than a width of the remaining part of the leg portion. When the leg portions are attached, a connection portion 79 is formed, as shown in FIG. 6. In a preferred embodiment, the leg portions 72 and 74 are connected via a snap fit. The connection flaps 76 and 78 are bent along bend lines G and H and can be punched to form either holes or dimples to facilitate connection with a second set of connection tabs. One pair of connection tabs 76 and 78 can be provided with holes and the other pair can be provided with dimples or other raised portions (not shown) that snap fit within the holes at a connection point 80, as shown in FIG. 6. With this snap fit of the dimples within the holes, one pair of the connection flaps 76 and 78 is pivotably fastened to the other pair at the connection point 80. Thus, the leg portions 72 and 74 can pivot with respect to each other about the connection point 80 and the stiffness of the armature is reduced. Since this embodiment has no inherent centering as in the previously described embodiments, a spring (not shown) can be provided between the two leg portions 72 and 74 to facilitate deflection of the leg portions 72 and 74 with respect to each other. The connection tabs 76 and 78 of one of the leg portions 72 and 74 will be spaced farther apart from each other to allow the connection tabs 76 and 78 of the other of the leg portions 72 and 74 to fit therebetween, as shown in FIG. 6. As can be seen in FIG. 6, one pair of flaps 76 and 78 overlaps with the other pair of flaps 76 and 78, providing a surface area in which magnetic flux may pass between the leg portion 72 and the leg portion 74. This surface area minimizes the magnetic reluctance between the leg portion 72 and the leg portion 74.

Figure 8:
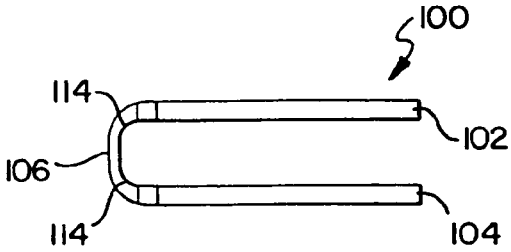
FIG. 8 is an elevational side view of a one-piece armature according to the present invention.

FIG.8 illustrates a one-piece armature 100 of the present invention. The armature 100 is generally U-shaped and comprises a first leg portion 102 and a second leg portion 104 that are offset by a connection portion 106 disposed generally perpendicularly therebetween. The first and second leg portions 102 and 104 are generally flat and are disposed such that they are generally parallel to each other.

Figure 9:
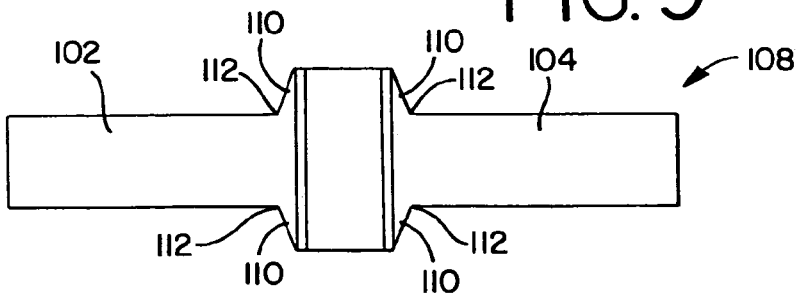
FIG. 9 is a top plan view of a blank used to form the one-piece armature shown in FIG. 8.
Figure 10:
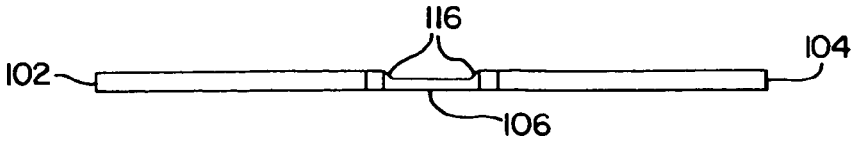
FIG. 10 is an elevational side view of the blank shown in FIG. 9.

The first and second leg portions 102 and 104 and the connection portion 106 are integrally formed from a blank 108, as shown in FIG. 9. The blank 108 is made of a metallic material having good magnetic permeability that can be fabricated and formed through conventional metal fabrication and forming techniques that are well known in the art. The connection portion 106 is wider than the first and second leg portions 102 and 104, as shown in FIG. 9, but has a material thickness that is less than the first and second leg portions 102 and 104, as shown in FIG. 10. The connection portion 106 also includes angled portions 110 integrally formed between the connection portion 106 and the first and second leg portions 102 and 104. The angled portions 110 help to guide the magnetic flux from the wide connection portion 106 to the narrower leg portions 102 and 104. The angled portions 110 also help reduce the material stresses that would normally be concentrated at corners 112, during and after fabrication, if those corners were positioned along bends 114 of the armature 100, as shown in FIG. 8. Additionally, the connecting portion includes tapered portions 116 that reduce material stresses along the bends 114 of the armature 100, as shown in FIG. 10. The tapered portions 116 reduce the material stresses normally associated with sharp corner bends in metal fabrication.

The reduced material thickness of the connection portion 106 reduces the stiffness of the connection portion 106 while the greater width of the connecting portion 106 compensates for the increased magnetic flux density that would be associated with the decreased cross-sectional area of the connection portion 106 due to the reduced material thickness. Thus, the additional cross-sectional area associated with the wider connection portion 106 minimizes the magnetic flux density of the connection portion 106, which allows the magnetically permeable material of the armature 100 to be able to perform at higher receiver drive levels.

In a preferred embodiment, the connection portion 106 is half as thick and twice as wide as the first and second leg portions 102 and 104. This configuration keeps the cross-sectional area constant throughout the armature 100, thereby preserving the armature's ability to carry magnetic flux. Furthermore, the increased width of the connection portion 106 in this configuration does not increase the stiffness of the connection portion 106, since material stiffness is a function of the cube of the material thickness while only proportional to the width of the material.

The reduced stiffness of the connection portion 106, combined with its increased width, allows maximum magnetic flux to pass through the connection portion 106, as well as the first and second leg portions 102 and 104, while allowing maximum deflection between the first and second leg portions 102 and 104 for maximum output sound pressure of a receiver incorporating the armature 100.

FIG. 11 shows an alternate embodiment in the form of an E-shaped armature 130. The armature 130 includes a generally flat first leg portion 132 and a generally flat second leg portion 134. The second leg portion 134 has two legs 135 and 136 disposed generally transverse to the first leg portion 132, as shown in FIG. 12. The first leg portion 132 is disposed between the two legs 135 and 136 as shown in FIG. 12 and below the two legs 135 and 136 as shown in FIG. 11. A connection portion 138 is in communication with the first and second leg portions 132 and 134, as shown in FIGS. 11 and. 12. The connection portion 138 includes a portion 140 having a material thickness that is less than the other portions of the armature 130. The reduced material thickness is best shown in FIG. 11. As shown in FIG. 12, the connection portion 138 includes angled portions 142 integrally formed between the portion 140 and the first leg portion 132, which is narrower than the portion 140. The angled portions 142 help to guide the magnetic flux from the portion 140 of the connection portion 138 to the narrower first leg portion 132.

The E-shaped armature 130 is formed from a blank 150, as shown in FIG. 13 and FIG. 14. The blank 150 is made of a metallic material having good magnetic permeability that can be fabricated and formed through conventional metal fabrication and forming techniques that are well known in the art.

The reduced material thickness of the portion 140 reduces its stiffness. This allows for an increased deflection of the first leg portion 132 with respect to the legs 135 and 136 of the second leg portion 134. The greater width of the connection portion 138 compensates for the increased magnetic flux density that would normally be associated with the decreased cross-sectional area of the portion 140 of the connection portion 138 due to the reduced material thickness without an increase in width. Thus, the additional cross-sectional area associated with the greater width minimizes the magnetic flux density associated with portion 140, which allows the magnetically permeable material of the armature 130 to be able to perform at higher receiver drive levels.

While the specific embodiments have been illustrated and described, numerous modifications may come to mind without significantly departing from the spirit of the invention, and the scope of protection is only limited by the scope of the accompanying Claims.

What is claimed is:

1. An armature for a receiver comprising:

a first armature leg portion having a thickness and a width;

a second armature leg portion having a thickness and a width, the second armature leg portion connected to the first armature leg portion; and a connection portion in communication with the first and second armature leg portions, the connection portion joining with the first and second armature leg portions to form a substantially U shaped armature, the connection portion having a width greater than the width of the first and second armature leg portions individually, the connection portion reducing the stiffness of the armature and minimizing magnetic reluctance of the connection between the first and second armature leg portions.

2. The armature of claim 1, wherein the first and second armature leg portions are separately formed.

3. The armature of claim 2, wherein the connection portion is formed by a first segment integrally formed with the first armature leg portion and a second segment integrally formed with the second armature leg portion, the first and second segments attached to each other to form the armature.

4. The armature of claim 1, wherein the first and second armature leg portions are spaced apart by the connection portion and generally parallel to each other.

* * * * *